United States Patent [19]

Maliszewski

[11] 4,234,132

[45] Nov. 18, 1980

[54] BOWL MILL WITH AIR DEFLECTOR MEANS

[75] Inventor: Theodore V. Maliszewski, Jr., North Canton, Conn.

[73] Assignee: Combustion Engineering, Inc., Windsor, Conn.

[21] Appl. No.: 41,155

[22] Filed: May 21, 1979

[51] Int. Cl.[3] ..... B02C 15/04

[52] U.S. Cl. ..... 241/53; 241/57; 241/119

[58] Field of Search ..... 241/53, 57, 119, 117

[56] References Cited

U.S. PATENT DOCUMENTS 3,465,971 9/1969 Dalenberg et al. ..... 241/53

*Primary Examiner*—Mark Rosenbaum

*Attorney, Agent, or Firm*—Arthur E. Fournier, Jr.

[57] ABSTRACT

A pulverizing bowl mill embodying improved air deflector means and particularly suited for use in effecting the grinding of material. The subject bowl mill includes a substantially closed separator body in which a grinding table is supported for rotation. A plurality of grinding rolls are supported within the separator body and cooperate with the rotating grinding table to effect the grinding of the material, which is disposed upon the grinding table. Air deflector means corresponding in number to the number of grinding rolls are mounted within the separator body so as to be located in juxtaposed relation to the inner surface of the separator body and so that an air deflector means is interposed between each pair of adjacent grinding rolls. An air supply means suitably formed in the separator body is associated with each of the air deflector means. Each of the air supply means is operable to supply air from an external source thereof therethrough to the interior of the separator body. A material supply means operable for supplying the material to be ground in the bowl mill is suitably formed in the separator body. Each of the air deflector means is operable to concomitantly perform both the function of effecting a leveling of material disposed on the rotating grinding table so as to present a uniform layer of material to the grinding roll located immediately downstream thereof and the function of encompassing all the air flow provided by the air supply means associated therewith for purposes of effecting the subsequent deflection thereby of this air flow over the rotating grinding table.

3 Claims, 4 Drawing Figures

BOWL MILL WITH AIR DEFLECTOR MEANS

BACKGROUND OF THE INVENTION

This invention relates to apparatus for grinding materials, and, more specifically, to a pulverizing bowl mill equipped with improved air deflector means that is particularly suited to be utilized for effecting the pulverization of coal.

It has long been known in the prior art to provide apparatus employable for purposes of effecting the grinding of materials. More specifically, the prior art is replete with examples of various types of apparatus that have been used heretofore to effect the grinding of a multiplicity of different kinds of materials. In this regard, in many instances discernible differences of a structural nature can be found to exist between individual ones of the aforesaid apparatus. The existence of such differences is, in turn, attributable for the most part to the diverse functional requirements that are associated with the individual applications in which such apparatus are designed to be employed. For instance, in the selection of the particular type of apparatus that is to be utilized for a specific application, one of the principal factors to which consideration must be given is that of the nature of the material that is to be ground in the apparatus. Coal is one such material wherein there is a need to grind it in order to render it suitable for use in certain applications. Furthermore, fossil fuel fired power generation systems represent one such application in which it is desired to employ coal, as the source of fuel therefor, and wherein a requirement exists to grind, i.e., pulverize the coal to render it suitable for use for this purpose.

To this end, coal has long been one of this nation's most abundant sources of fuel. At one time earlier in this century, much of the nation's energy needs were being met through the use of coal. Then, a decline set in in the degree to which coal was being employed to generate power. Much of this decline stemmed from the increased usage of oil and gas as sources of fuel. More recently, the power being generated from the burning of oil and gas has been supplemented by the use of nuclear fuel for power producing purposes. However, with the advent of the oil embargo earlier in this decade, which was accompanied by sharp increases in the price of oil and the existence of restricted oil supplies, and the increased concern, which has since been expressed over the rate at which the world's known oil reserves are being depleted, coal has begun to regain some of the favor which it once had as a source of fuel to meet the nation's energy needs. To some extent, this has been evidenced in the number of orders which have been placed in recent years for power generation systems that are to be coal fired as well as the extent to which increased interest is being shown in effecting the conversion of existing oil- and gas-fired power generation systems to coal-fired systems.

For purposes of the discussion that follows, the coal-fired systems referred to above are considered to consist of essentially the following major operating components: A coal feeder, apparatus for pulverizing coal, a distribution system for distributing the coal after the pulverization thereof, a furnace in which the coal is to be burned and the requisite controls for effecting the proper operation of the coal-fired power generation system. Of particular interest herein is that portion of the coal-fired system which has been identified above as the apparatus for pulverizing the coal. Coal pulverizing apparatus are not new. They have been known to exist in the prior art for more than half a century. Furthermore, many improvements in the construction and/or mode of operation of coal pulverizing apparatus have been made during this period.

There are a number of features that it is advantageous for any coal pulverizing apparatus to possess, but particularly those which are designed for employment in a coal-fired power generation system. Reference is had here to features such as reliability, low power consumption, minimum maintenance and wide range of capacity. In addition, such apparatus advantageously should also be characterized by quiet operation, integrated lubrication systems, convenient adjustment and control of coal flow and fineness, and the ability to handle the high temperature air that is required for high moisture coal.

One particular type of coal pulverizing apparatus which is to be found in the prior art that is advantageously characterized by the embodiment therein of the above-recited features is an apparatus most commonly referred to in the industry by the name bowl mill. The latter apparatus obtains its name by virtue of the fact that the pulverization, i.e., grinding, of the coal which takes place therein is effected on a grinding surface that in configuration bears a resemblance to a bowl.

Reference may be had, by way of exemplification, to U.S. Pat. No. 3,465,971, the latter being assigned to the same assignee as the instant application, for a teaching of the nature of the construction and the mode of operation of a prior art form of bowl mill that is suitable for use in a coal-fired power generation system to effectuate the pulverization of the coal that is to be burned as fuel therein. As taught by the afore-referenced patent, a bowl mill essentially consists of a body portion in which a grinding table is mounted for rotation, a plurality of grinding rollers that coact with the grinding table to effect the grinding of coal interposed therebetween, coal supply means for feeding to the interior of the bowl mill the coal that is to be pulverized, and air supply means for supplying to the interior of the bowl mill the air required in the operation of the latter. In accordance with the mode of operation of such a bowl mill, the coal, which enters the bowl mill, is pulverized by virtue of the coaction of the grinding rollers with the grinding table. After being pulverized, the coal particles are thrown outwardly by centrifugal force whereby the particles are fed into a stream of air that is entering the bowl mill. The stream of air, which now contains pulverized coal particles, flows through a tortuous path that is established in part by the positioning within the bowl mill of a suitably supported deflector means. As the stream of air and coal particles flows along the aforementioned tortuous path, the sharp turns contained therein effects the separation of the coarse coal particles from the air stream. These coarse coal particles are then suitably returned to the grinding table for further pulverization, while the fine coal particles are carried through the bowl mill in the air stream, and exit therefrom along with the air.

In a conventional coal-fired power generation system, a multiplicity of bowl mills of the type shown in the afore-referenced patent would commonly be employed for purposes of satisfying the requirements of the system for pulverized coal. By way of example, the capacity of each of the individual bowl mills might be on the order of one hundred tons per hour of coal.

Although bowl mills constructed in accordance with the teachings of the afore-referenced patent have, under actual operating conditions, proven capable of providing adequate performance to date, a need has nevertheless been evidenced for improvements to be made therein. More specifically, prolonged operation of this type of bowl mill has revealed the existence of several conditions of an undesirable nature that can arise during the use thereof. One of these stems from the fact that a space exists between the outer surface of the deflector means and the inner surface of the separator body, which serves to create an opening therebetween. During operation of the bowl mill, it has been found that coal particles tend to flow through this opening and/or accumulate therein, which, in turn, can adversely affect the performance desired from the bowl mill. Attempts to close these openings have only had the affect of tending to increase the susceptibility of coal particles to accumulate at such locations. Another disadvantage of a bowl mill equipped with deflector means of the type illustrated in the afore-referenced patent is that the deflector means is incapable of encompassing all of the air flow. The failure to do so produces poor circulation of air through the bowl mill as well as mill deterioration. A need has, therefore, been evidenced for a bowl mill embodying improved air deflector means, the latter being characterized by the following capabilities: The ability to encompsss all of the air flow, the ability to deflect the circulating air over the grinding table such that all air flow is diverted from the internal components of the bowl mill, the ability to supply a uniform layer of coal to each grinding roll, and the ability to inhibit the creation of pockets of stagnant air, particularly in the areas adjacent to the grinding rolls and/or the grinding table.

It is, therefore, an object of the present invention to provide a new and improved bowl mill suitable for use particularly in effecting the pulverization of coal.

It is another object of the present invention to provide such a bowl mill embodying improved air deflector means whereby the bowl mill equipped therewith is particularly suited for use in coal-fired power generation systems that require large quantities of pulverized coal.

It is still another object of the present invention to provide such a bowl mill having improved air deflector means that is operable to encompass all of the air flow entering the bowl mill.

A further object of the present invention is to provide such a bowl mill having improved air deflector means that is operable to deflect the circulating air over the grinding table such that all air flow is diverted from the internal components of the bowl mill.

A still further object of the present invention is to provide such a bowl mill having improved air deflector means that is operable to supply a uniform layer of coal to each grinding roll.

Yet another object of the present invention is to provide such a bowl mill having improved air deflector means that is operable to inhibit the creation of pockets of stagnant air, particularly in the areas surrounding the grinding rolls and/or the grinding table.

Yet still another object of the present invention is to provide such a bowl mill having improved air deflector means that is advantageously characterized by ease of manufacture and installation as well as by its relatively long life.

SUMMARY OF THE INVENTION

In accordance with the present invention, there is provided a pulverizing bowl mill equipped with improved air deflector means, which is particularly suited for use in effecting the pulverization of coal. The subject pulverizing coal mill includes a substantially closed separator body, a grinding table mounted for rotation within the separator body, a plurality of grinding rolls supported in slightly spaced relation to the grinding table and cooperative therewith to effect the pulverization of coal that is disposed on the grinding table, air supply means formed in the separator body and operative for supplying air to the interior thereof, coal supply means formed in the separator body and operative for supplying the coal that is to be pulverized in the bowl mill to the interior thereof, and a multiplicity of air deflector means corresponding in number to the number of grinding rolls that are embodied in the bowl mill. The air deflector means of new and improved construction that the subject pulverizing bowl mill embodies are suitably mounted within the separator body so as to be located in juxtaposed relation to the inner surface of the separator body and so that an air deflector means is interposed between each pair of adjacent grinding rolls. Moreover, each of the air deflector means is suitably positioned so as to receive a supply of air from the air supply means. In addition, the air deflector means are each operable to concomitantly perform both the function of effecting a leveling of the coal disposed on the rotating grinding table so as to cause a uniform layer of coal to be presented to the grinding roll located immediately adjacent thereto on the downstream side thereof, and the function of encompassing all of the air flow provided thereto by the air supply means such that the air deflector means is, thus, operative to effect the subsequent deflection of the entire air flow over the rotating grinding table.

DESCRIPTION OF A PREFERRED EMBODIMENT

Figure 1:
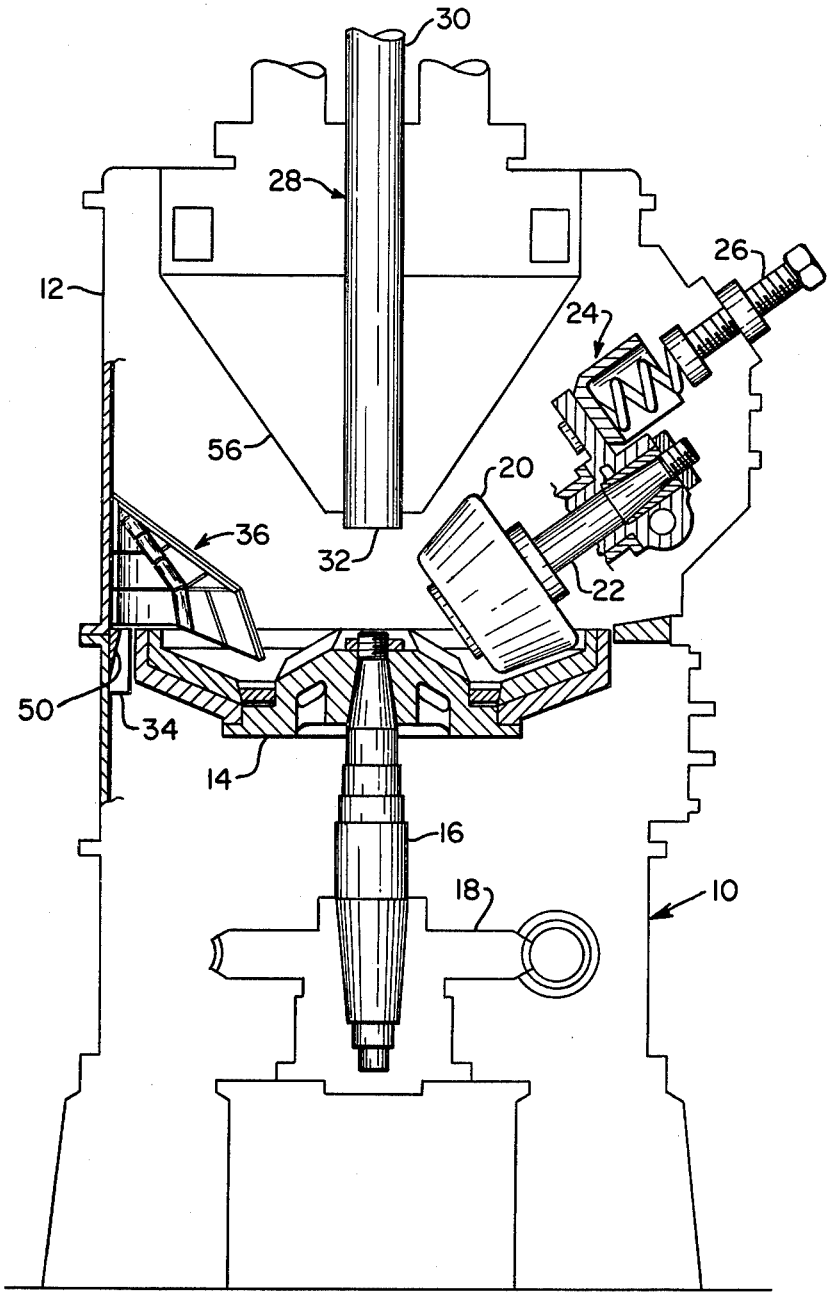
FIG. 1 is a sectional side view of a pulverizing bowl mill constructed in accordance with the present invention.

Referring now to the drawing and, more particularly, to FIG. 1 thereof, there is depicted therein a pulverizing bowl mill, generally designated by reference numeral 10, constructed in accordance with the present invention. Inasmuch as the nature of the construction and the mode of operation of pulverizing bowl mills per se are well known to those skilled in the art, it is not deemed necessary, therefore, to set forth herein a detailed description of the pulverizing bowl mill 10 illustrated in FIG. 1 of the drawing. Rather, it is deemed sufficient for purposes of obtaining an understanding of the pulverizing bowl mill 10 embodying improved air deflector means in accordance with the present invention to merely present herein a description of the nature of the construction and the mode of operation of the components of the pulverizing bowl mill 10 with which the aforesaid air deflector means cooperates. For a more detailed description of the nature of the construction and the mode of operation of the components of the pulverizing bowl mill 10, which are not described in depth herein, one may have reference to the prior art, e.g., U.S. Pat. No. 3,465,971, which issued Sept. 9, 1969 to J. F. Dalenberg, et al.

Referring further to FIG. 1 of the drawing, the pulverizing bowl mill 10, as illustrated therein, includes a substantially closed separator body 12. A grinding table 14 is suitably supported within the separator body 12 for rotation relative thereto. More specifically, the grinding table 14 is mounted on a shaft 16, which, in turn, is operatively connected to a worm gear drive mechanism, generally designated by reference numberal 18, so as to be capable of being rotatably driven thereby. With the aforesaid components arranged within the separator body 12 in the manner depicted in FIG. 1 of the drawing, the worm gear drive mechanism 18 is operative to drive the grinding table 14 in a clockwise direction.

Continuing with a description of the pulverizing bowl mill 10, a plurality of grinding rolls 20, preferably three in number in accordance with the best mode embodiment of the invention, are suitably supported within the interior of the separator body 12 so as to be equidistantly spaced one from another around the circumference of the separator body 12. In the interest of maintaining clarity of illustration in the drawing, only one such grinding roll 20 has been shown in FIG. 1. With further regard to the grinding rolls 20, each of the latter, as best understood with reference to FIG. 1 of the drawing, is preferably supported on a shaft 22, which, in turn, is cooperatively associated with spring means, generally designated by reference numeral 24. The spring means 24 is operative to urge the shaft 22 and thereby the grinding roll 20 towards the surface of the grinding table 14. To this end, in accordance with the practice commonly followed in the pulverizing bowl mill art, each of the spring means 24 preferably has cooperatively associated therewith adjustment means 26, the latter being operative to enable adjustments to be made in the spacing between the grinding roll 20 and the surface of the grinding table 14 on which the pulverization of the coal occurs.

The material, i.e., coal, that is to be pulverized in the bowl mill 10 is introduced therein by means of coal supply means, generally designated by reference numeral 28, with which the separator body 12 is suitably provided. In accordance with the illustrated embodiment of the pulverizing bowl mill 10, the coal supply means 28 includes a suitably dimensioned duct having one end thereof 30 extending outwardly of the separator body 12 for connection to a suitable supply of coal that is to be pulverized. The other end 32 of the duct of the coal supply means 28 is operative to discharge the coal onto the surface of the grinding table 14. To this end, as shown in FIG. 1 of the drawing, the duct end 32 preferably is suitably supported within the separator body 12 through the use of any suitable form of conventional support means (not shown) such that the duct end 32 is coaxially aligned with the shaft 16 that supports the grinding table 14 for rotation, but is spaced a suitable distance from the grinding surface of the grinding table 14.

In accord with the mode of operation of pulverizing bowl mills of conventional construction, a gas such as air is utilized to effect the conveyance of the coal from the grinding table 14 through the interior of the separator body 12 for discharge from the pulverizing bowl mill 10. The air provided for this purpose enters the separator body 12 through a suitable opening (not shown) provided therein for this purpose. From the aforesaid opening (not shown) in the separator body 12, the air flows to a multiplicity of annular spaces 34, only one of which is shown in FIG. 1 of the drawing in the interest of maintaining clarity of illustration therein. More specifically, in a manner yet to be described, the pulverizing bowl mill 10 is preferably provided in accordance with the best mode embodiment of the invention with three such annular spaces 34. Namely, the number of annular spaces 34 embodied in the bowl mill 10 corresponds in number to at least the number of grinding rolls 20 with which the bowl mill 10 is provided for reasons which will become more apparent from the discussion that follows hereinafter.

In accordance with the present invention, the pulverizing bowl mill 10 embodies new and improved air deflector means, generally designated in the drawing by reference numeral 36. More specifically, in accord with the best mode embodiment of the invention, the pulverizing bowl mill 10 is provided with three such air deflector means 36. Inasmuch as each of the three air deflector means 36 is identical, both in construction and in mode of operation, it has been deemed sufficient for purposes of obtaining an understanding thereof and in the interest of maintaining clarity of illustration in the drawing to show only one of the three air deflector means 36 in FIG. 1 of the drawing.

Figure 2:
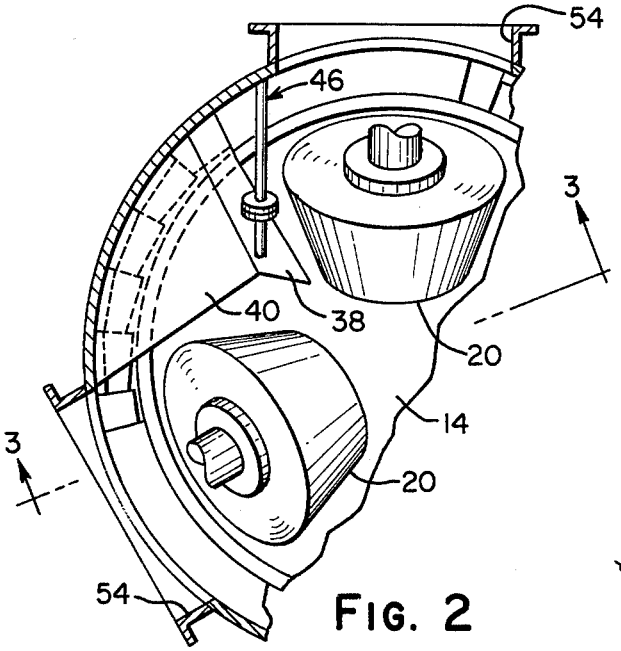
FIG. 2 is a top plan view, partially in section of a portion of a pulverizing bowl mill constructed in accordance with the present invention depicting, by way of exemplification, the relationship which an air deflector means bears to a cooperating pair of grinding rolls.
Figure 4:
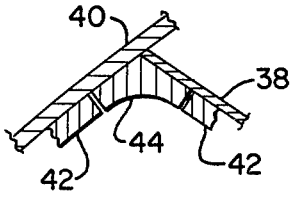
FIG. 4 is a cross-sectional view of a portion of a pulverizing bowl mill constructed in accordance with the present invention, taken substantially along the line 4—4 in FIG. 3 of the drawing.
Figure 3:
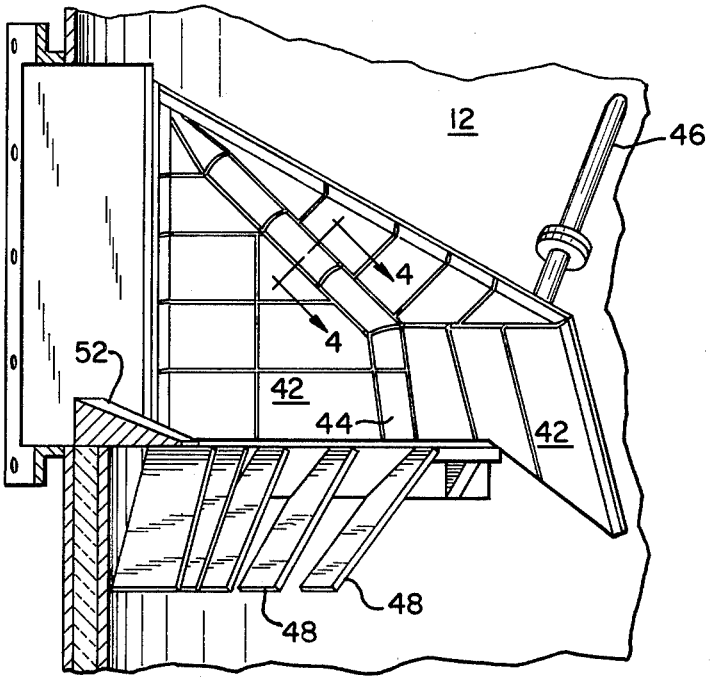
FIG. 3 is a cross-sectional view of a portion of a pulverizing bowl mill constructed in accordance with the present invention, taken substantially along the line 3—3 in FIG. 2 of the drawing.

Turning now to a consideration of the nature of the construction of the air deflector means 36, reference will be had for this purpose, particularly to FIGS. 2–4 of the drawing. As shown therein, the air deflector means 36 is generally triangular in configuration. More specifically, the air deflector means 36 includes a plurality of plate-like members 38, 40 that are suitably joined together through the use of any conventional form of joining means (not shown) such as welding to form a frame-like structure. The inner surface of the air deflector means 36, i.e., the inner surfaces of the members 38, 40 are preferably covered with a suitable liner material. That is, in accord with the illustrated embodiment of the invention, individual liner panels 42 are suitably secured on the plate-like members 38, 40 through the use of any conventional form of securing means (not shown).

The primary function of the liner panels 42 is to resist the abrasive action induced by the air flow striking against the inner surface of the air deflector means 36. The nature of this air flow and the relationship it bears to the operation of the air deflector means 36 will be described herein more fully subsequently. This abrasive action is undesirable inasmuch as it can cause the occurrence of erosion of the plate-like members 38, 40. Consequently, the liner panels 42 are preferably fabricated of any suitable conventional form of material that is noted for its resistance to abrasion characteristics. Moreover, the liner panels 42 are preferably designed to be easily replaced so that as the liner panels 42 wear, they may be replaced as required without necessitating the replacement of the entire air deflector means 36.

Note should also be taken at this point of the fact that in accord with the best mode embodiment of the invention and as best understood with reference to FIG. 4 of the drawing, at the joint formed by the interconnection of the plate-like member 38 with the plate-like member 40, liner panels 44 are employed that are characterized in that they cooperate with the liner panels 42 that are supported in adjacent relation thereto to provide a rounded, i.e., curved surface. To this end, the liner panels 44 each embody a suitable radius of curvature so as to be operative to transform the rectangular configuration of the interconnection of the plate-like members 38, 40 into a curved surface. Through the use of the aforedescribed rounded surfaces at the joint formed by the interconnection of the plate-like members 38, 40 the interior of the air deflector means 36 is made to operate much in the manner of an air foil as the air deflector means 36 performs its intended function of deflecting the air that flows in proximity thereto.

Continuing with the description of the air deflector means 36, the latter is suitably supported within the separator body 12 so as to be located in abutting relation to the inner surface of the separator body 12. More specifically, the air deflector means 36 is preferably supported by means of strut means, generally designated by reference numeral 46 in the drawing. The latter strut means 46 includes a suitably dimensioned strut member having one end thereof suitably attached to the external surface of the air deflector means 36 and the other end thereof suitably attached to the inner surface of the separator body 12. Any suitable conventional form of attaching means (not shown) may be utilized for purposes of effecting the attachment of the respective ends of the aforereferenced strut member to the air deflector means 36 and the separator body 12, respectively. In addition, the portion of the air deflector means 36, which abuts against the inner surface of the separator body 12 may be fastened to the latter through the use of any suitable conventional form of fastening means (not shown). For reasons which will become more apparent subsequently, it is important that no gap exists between the inner surface of the separator body 12 and the abutting portion of the air deflector means 36 through which the material to be pulverized, e.g., coal, can pass and/or accumulate therewithin.

The air deflector means 36 is suitably located within the separator body 12 such that it bears a predetermined relationship to the grinding roll 20 located immediately upstream of it and to the grinding roll 20 located immediately downstream thereof, and such that the air deflector means 36 bears a predetermined relationship to the one of the three annular spaces 34 located most closely thereto. With reference to the matter of the annular spaces 34, as noted previously hereinabove there is one such annular space 34 associated with each of the three grinding rolls 20 and concomitantly with each of the three air deflector means 36. The annular space 34 basically comprises an annular passage, i.e., opening formed between the inner surface of the separator body 12 and the circumference of the grinding table 14. It is through these annular spaces 34 that the air, which enters the separator body 12, is funneled from below the grinding table 14 to above the latter.

In accord with the illustrated embodiment of the invention, a series of vanes 48 are preferably supported in mounted relation through the use of any suitable conventional form of mounting means (not shown), within the annular space 34 so as to divide the latter into a plurality of sections operative to channel, i.e., direct the air flow therethrough. Although not shown in the drawing, in the interest of maintaining clarity of illustration therein, it is to be understood that each of the annular spaces 34 formed in the pulverizing bowl mill 10 is equipped with the aforedescribed air flow directing vanes 48.

As best understood with reference to FIG. 1 of the drawing, a suitably configured member 50, preferably of generally triangular configuration is mounted within each of the channels formed in the annular space 34 by the vanes 48. In this regard, the members 50 are mounted adjacent the exit, i.e., upper end of the annular space 34. The primary function of the members 50 is to effect a disengagement from the sidewalls of the annular space 34 of the air as the latter flows therealong. In essence, the members 50, thus, effectively function to peel the air away from the side walls of the annular space 34 as the air reaches the exit end of the latter. This peeling away of the air flow from the side walls of the annular space 34 essentially starts the process of air flow deflection that is subsequently effected through the action of the air deflector means 36. In this regard, it is important to note here that for a purpose which will become clearer subsequently, the air deflector means 36 is suitably dimensioned so as to be of sufficient size as to encompass the entire area occupied by the annular space 34 that is associated therewith.

Continuing with the description of the air deflector means 36, there are a number of factors that influence both the determination of the size and configuration of the air deflector means 36, as well as the relative positioning of the air deflector means 36 within the separator body 12. In this regard, as has been previously pointed out above, the air deflector means 36 is formed so as to be of sufficient size as to be capable of capturing all of the air flow exiting from the annular space 34. Moreover, the internal configuration, which the air deflector means 36 embodies, is such as to enable the latter to function much in the manner of an air foil relative to the flow of air exiting from the cooperating annular space 34.

With regard to the matter of the positioning of the air deflector means 36, the latter is suitably located so as to be interposed between a pair of grinding rolls 20. More specifically, the air deflector means 36 is suitably supported on the inner surface of the separator body 12 such that with the grinding table being rotated in a clockwise direction as viewed with reference to FIG. 2 of the drawing, the plate-like member 38 of the air deflector means 36 is suitably spaced from the grinding roll 20 which is located downstream thereof so that in a manner yet to be described the free edge of the plate-like member 38 is operative as a leveling means for the material that is disposed on the rotating grinding table 14. Furthermore, the air deflector means 36 is suitably positioned relative to the pair of grinding rolls 20 that are located on either side thereof such that the free edge of the plate-like member 40 of the air deflector means 36 is suitably spaced relative to the grinding roll 20 located upstream thereof so as to inhibit the establishment of an area of stagnant air between the air deflector means 36 and the upstream grinding roll 20. Further reference will be had herein subsequently to this matter of air stagnation.

There are two other features of the pulverizing bowl mill 10 constructed in accordance with the present invention to which it is desired to have reference herein. First, as best understood with reference to FIG. 3 of the drawing, in accordance with the best mode embodiment of the invention, a wedge-shaped member 52 is suitably mounted adjacent to the upstream end of the annular space 34, through the use of any conventional form of mounting means (not shown). The aforesaid member 52 is suitably positioned so as to extend substantially radially from the inner surface of the separator body 12. Moreover, the member 52 is of sufficient length so as to be capable of spanning the distance measured from the inner surface of the separator body 12 to the circumference of the rotating grinding table 14. The primary function of the member 52 is to prevent material, e.g., coal, which is being subjected to pulverization, from falling into and/or through the annular space 34. To this end, the member 52 is suitably configured so as to effect the deflection of any material engaged thereby radially inwardly towards the rotating grinding table 14 and, thus, away from the annular space 34.

Secondly, the pulverizing bowl mill 10, as illustrated in the drawing, is provided with an opening 54 suitably formed in the separator body 12 adjacent to the location of each of the three grinding rolls 20. Only two of the three openings 54, which the pulverizing bowl mill 10 embodies, are visible in the drawing. Each of the openings 54 is designed to be closed by a suitable door-like member. The function of the opening 54 is to enable access to be had to the interior of the separator body 12, and, more particularly, to the operating components housed therewithin.

There will now be set forth a description of the mode of operation of the pulverizing bowl mill 10 equipped with air deflector means 36 constructed in accordance with the present invention. Referring for this purpose particularly to FIG. 1 of the drawing, the material to be pulverized within the bowl mill 10 is discharged from the duct end 32 onto the grinding table 14. The orientation of the duct end 32 relative to the grinding table 14 is such that the material, e.g., coal, is discharged substantially at the center of the grinding table 14. As the grinding table 14 is rotated, the coal, which is disposed thereon, is pulverized through the coaction of the grinding rolls 20 with the surface of the grinding table 14. In this regard, the free edge of the plate-like member 38 operates as a leveling means to ensure that a uniform layer of coal is being presented for pulverization to the grinding roll 20 that is located immediately downstream thereof. Following pulverization, the coal particles which are produced as a result thereof, are thrown outwardly away from the center of the grinding table 14 by centrifugal force.

Concomitant with the pulverization of the coal, a suitable supply of air is being fed to the annular spaces 34. All of the air flow exiting from each of the annular spaces 34 is captured by the air deflector means 36 cooperatively associated therewith. More specifically, the three air deflector means 36 are operative to deflect all of the circulating air discharged by the three air deflector means 36 over the grinding table 14, and thereby, thus, away from the other components that are housed internally of the bowl mill 10. In the vicinity of the air deflector means 36 to which the coal particles have been thrown by centrifugal force following pulverization, the coal particles are picked up by the circulating air flowing from the annular spaces 34 and flows along therewith. Note is taken here of the existence of the members 50 suitably positioned within the annular spaces 34, which are operative to effect the peeling away of the air flow from the side walls of the annular spaces 34. In addition, note is taken of the fact that it is important that the free edge of the plate-like member 40 be suitably spaced from the grinding roll 20 located immediately upstream thereof so as to insure the air exiting from the annular space 34 does not become stagnated. More specifically, it is important that air circulation be maintained in the area surrounding the upstream grinding roll 20. Should the air stagnate, coal particles being thrown outwardly by centrifugal force into this area will not enter an air stream and thereby be carried away therewith.

The combined stream of coal particles and air flows along the inner surface, i.e., follows the contours, of the air deflector means 36 and exits therefrom under the free edges of the plate-like members 38, 40, i.e., is discharged through the space, which exists between the free edges of the plate-like members 38, 40 and the surface of the grinding table 14. In order to flow through the aforedescribed space, the combined stream of coal particles and air is forced to undergo a sharp turn. In doing so, the heavier coal particles having more inertia become separated from the stream and fall back onto the surface of the grinding table 14 whereupon they undergo further pulverization. The smaller coal particles, on the other hand, because they have less inertia, are carried along in the air stream. After leaving the air deflector means 36, the combined stream of coal particles and air flows to a classifier of conventional construction, generally designated by reference numeral 56. The classifier 56 is operative to effect a further sorting of the coal particles being carried along with the air. Namely, those coal particles, which are of the desired size, pass through the classifier 56 and are discharged along with the air from the bowl mill 10 whereas those coal particles which are of undesired size are returned to the grinding table 14 for further pulverization in a manner well known to those skilled in the art. Again, mention is made of the fact that the abrasive nature of the combined stream of coal particles and air striking against the air deflector means 36 is designed to be resisted by the liner panels 42, 44, which line the inner surface of the air deflector means 36. Note is also taken of the fact that the wedge-shaped members 52 function to inhibit the passage of coal into and through the annular spaces 34.

In summary, the pulverizing bowl mill 10 equipped with the air deflector means 36 is advantageously characterized in the fact that it does not suffer from the undesirable features that disadvantageously characterize prior art forms of pulverizing bowl mills. Namely, in contradistinction to deflector means of prior art forms of bowl mills, the air deflector means 36 of the bowl mill 10 is operable to capture all of the air that flows from the annular spaces 34 thereby enhancing the circulation of air within the bowl mill 10 such that the flow of air required for the effective and efficient operation of the bowl mill 10 is present. Additionally, the air deflector means 36 is operative with the members 52 to inhibit the buildup of undesired deposits of coal in the regions located between the air deflector means 36 and the inner surface of the separator body 12 as well as the passage of coal into and through the annular spaces 34 into the region of the separator body 12 located below the grinding table 14. The existence of coal deposits in the aforedescribed internal regions of the bowl mill 10 are to be avoided because of the adverse effects they can have on the ability to insure safe and reliable operation of the bowl mill.

Thus, in accordance with the present invention, there has been provided a new and improved bowl mill suitable for use particularly in effecting the pulverization of coal. Moreover, the subject bowl mill embodies improved air deflector means whereby the bowl mill equipped therewith is particularly suited for use in coal-fired power generation systems that require large quantities of pulverized coal. In addition, in accord with the present invention, a bowl mill having improved air deflector means is provided, which is operative to encompass all of the air flow entering the bowl mill. Further, the bowl mill having improved air deflector means of the present invention is operable to deflect the circulating air over the grinding table such that all air flow is diverted from the internal components of the bowl mill. Additionally, in accordance with the present invention, a bowl mill having improved air deflector means is provided that is operable to supply a uniform layer of coal to each grinding roll. Also, the bowl mill having improved air deflector means of the present invention is provided that is operable to inhibit the creation of pockets of stagnant air particularly in the areas surrounding the grinding rolls and/or the grinding table. Furthermore, in accord with the present invention, a bowl mill having improved air deflector means is provided that is advantageously characterized by ease of manufacture and installation as well by its ability to provide relatively long life. While only one embodiment of my invention has been shown, it will be appreciated that modifications thereof, some of which have been alluded to hereinabove, may still be readily made thereto by those skilled in the art. I, therefore, intend by the appended claims to cover the modifications alluded to herein as well as all other modifications, which fall within the true spirit and scope of my invention.

I claim:

1. In a bowl mill operable for effecting therewithin the pulverization of material such as coal and including a separator body the inner surfaces of which define a substantially closed chamber therebetween, a grinding table supported for rotation within the separator body, means for rotating the grinding table within the separator body, at least one pair of grinding rolls mounted within the separator body in space relation one to another and in juxtaposed relation to the grinding table so as to coact therewith for purposes of effecting the pulverization of material disposed on the grinding table, material supply means supported on the separator body and operable for discharging onto the grinding table the material to be pulverized within the bowl mill, air supply means provided in the separator body terminating in at least one discharge outlet comprising an annular space formed between the inner surface of the separator body and circumference of the grinding table so as to be operative for purposes of discharging a flow of air through the annular space into the interior of the separator body, the improvement comprising:

a. an air deflector means disposed between the pair of grinding rolls in the path of flow of the air exiting through the annular space and operative deflect this flow of air over the grinding table, said air deflector means including a frame-like structure lined with an abrasive resistant material, said frame-like structure being of sufficient size to encompass the entire annular space so as to thereby effect the capture of all of the air exiting from the annular space, said frame-like structure including at least a first side wall and a second side wall joined to said first side wall, said first side wall extending substantially perpendicular to the plane of rotation of the grinding table and terminating in a free edge, said second side wall extending substantially parallel to the plane of rotation of the grinding table and terminating in a free edge;

b. support means supporting said frame-like structure within the separator body so that at least a portion of said frame-like structure is located in abutting engagement with the inner surface of the separator body preventing thereby the flow of air and material between the inner surface of the separator body and said frame-like structure, said support means also supporting said frame-like structure so that said first side wall is positioned in spaced relation to a first one of the pair of grinding rolls such that said free edge of said first side wall is operative as a leveler to insure the presentation of a uniform layer of material to the first one of the pair of grinding rolls and so that said second side wall is positioned in spaced relation to the second one of the pair of grinding rolls such that said free edge of said second side wall is spaced a sufficient distance from the second one of the pair of grinding rolls in order to thereby inhibit the development of an area of stagnant air therebetween; and c. means provided in the annular space adjacent the exit end thereof, said means being mounted on the side walls that define the annular space so as to have one end thereof positioned adjacent the exit end of the annular space and the other end thereof located within the annular space at a spaced distance from said one end thereof, said one end of said means projecting inwardly into the annular space to a considerably greater extent than does said other end of said means so as to establish an inclined surface therebetween, said inclined surface lying within the path of flow of air through the annular space so as to be operative to effectuate a peeling away of the air from engagement with the side walls that define the annular space as the flow of air exits from the annular space prior to the engagement of the flow of air with said frame-like structure and the subsequent deflection of the flow of air over the grinding table by said frame-like structure.

2. In a bowl mill as set forth in claim 1 having three grinding rolls supported within the separator body, the improvement comprising a plurality of air deflector means supported within the separator body, said plurality of air deflector means corresponding in number to the number of annular spaces provided in the separator body, each of said plurality of air deflector means being disposed between a pair of grinding rolls and in juxtaposed relation to an annular space, each of said plurality of air deflector means being of sufficient size to encompass the corresponding one of the annular spaces in its entirety so as to thereby effect the capture of all of the air exiting therefrom for subsequent deflection by the corresponding one of said plurality of air deflector means of this flow of air over the grinding table.

3. In a bowl mill as set forth in claim 2 wherein said plurality of air deflector means comprises 3.

* * * * *